US008029334B2

(12) United States Patent
Kundig

(10) Patent No.: US 8,029,334 B2
(45) Date of Patent: Oct. 4, 2011

(54) DEVICE FOR MODIFYING THE POSITION OF THE SEGMENTS IN THE EVENT OF THE INCLINATION OF A SEGMENTED GRINDING PAD

(76) Inventor: Stephan Kundig, Rapperswil (CH)

( * ) Notice: Subject to any disclaimer, the term of this patent is extended or adjusted under 35 U.S.C. 154(b) by 583 days.

(21) Appl. No.: 11/910,402

(22) PCT Filed: Mar. 27, 2006

(86) PCT No.: PCT/EP2006/061059

§ 371 (c)(1),
(2), (4) Date: May 20, 2008

(87) PCT Pub. No.: WO2006/103208

PCT Pub. Date: Oct. 5, 2006

(65) Prior Publication Data

US 2008/0287048 A1 Nov. 20, 2008

(30) Foreign Application Priority Data

Apr. 1, 2005 (CH) ..... 595/05

(51) Int. Cl.
*B24B 21/00* (2006.01)

(52) U.S. Cl. ..... 451/11; 451/303

(58) Field of Classification Search ..... 451/9, 10, 451/11, 299, 300, 303
See application file for complete search history.

(56) References Cited

U.S. PATENT DOCUMENTS

| | | | | | |
|---|---|---|---|---|---|
| 2,258,733 | A | * | 10/1941 | Brackett | 451/168 |
| 3,374,583 | A | * | 3/1968 | Jacobi | 451/300 |
| 3,694,966 | A | * | 10/1972 | Heesemann | 451/300 |
| 4,527,359 | A | * | 7/1985 | Stump et al. | 451/300 |
| 4,601,134 | A | * | 7/1986 | Hessemann | 451/300 |

FOREIGN PATENT DOCUMENTS

| | | | |
|---|---|---|---|
| WO | 2004009290 | A | 1/2004 |
| WO | 2005018877 | A | 3/2005 |

OTHER PUBLICATIONS

Mar. 27, 2006 International Preliminary Patentability Report in PCT/EP2006/061059.

* cited by examiner

*Primary Examiner* — Maurina Rachuba
(74) *Attorney, Agent, or Firm* — Oliff & Berridge, PLC

(57) ABSTRACT

A device is described comprising: a segmented sanding pad having a plurality of segments, each segment having a longitudinal axis and corresponding to a respective contact roller having a longitudinal axis, wherein, when the sanding pad is moved obliquely, the segments align in accordance with a degree of oblique movement, characterized in that the longitudinal axes of the individual contact rollers and the respective segments are aligned with respect to each other when the gap between the segments is adjusted to the longitudinal axis of the contact rollers.

2 Claims, 4 Drawing Sheets

DEVICE FOR MODIFYING THE POSITION OF THE SEGMENTS IN THE EVENT OF THE INCLINATION OF A SEGMENTED GRINDING PAD

TECHNICAL FIELD AND BACKGROUND OF THE INVENTION

This invention makes reference to sanding belt engineering. It describes adjusting of the position of the segments to match an oblique alignment of a segmented sanding pad.

An example of oblique alignment of a segmented sanding pad is described in the patent application under the international file nos./international application dates PCT/CH02/00415 filed Jul. 22, 2002 and PCT/CH04/000509 filed Aug. 16, 2004.

SUMMARY OF THE INVENTION

During oblique alignment of a segmented sanding pad (11, 12, 13) a through feed belt-sanding machine has the problem of varying position of a contact roller series (15) with respect to an original, for example perpendicular, segment series (11) position. The invention demonstrates a close rebalancing of the occurring deviation due to the lateral shift of segments $S_1 \ldots S_n$, by means of a lever device (16) or positioning motor. A complete compensation for the deviation of the segments from their longitudinal axis to the contact rollers can be achieved through a custom design of such a device.

According to one embodiment, a device comprises a segmented sanding pad having a plurality of segments, each segment having a longitudinal axis and corresponding to a respective contact roller having a longitudinal axis, wherein, when the sanding pad is moved obliquely, the segments align in accordance with a degree of oblique movement, characterized in that the longitudinal axes of the individual contact rollers and the respective segments are aligned with respect to each other when the gap between the segments is adjusted to the longitudinal axis of the contact rollers.

According to another embodiment, a device comprises a segmented sanding pad having a plurality of segments, each segment having a longitudinal axis and corresponding to a respective contact roller having a longitudinal axis, wherein, when the sanding pad is moved to an oblique position, the segments are positioned to align with respective corresponding contact rollers, characterized in that the longitudinal axes of the individual contact rollers and the respective segments are aligned with respect to each other when the gap between the segments is adjusted to the longitudinal axis of the contact rollers.

DETAILED DESCRIPTION OF THE PREFERRED EMBODIMENT AND BEST MODE

The current state of technology knows the advantages of the oblique alignment of a belt-sanding unit and the combination of an obliquely alignable belt-sanding unit with a segmented sanding pad, as described in the above-quoted patent submissions.

From Patent Application PCT/CH2004/000509 a device is known which, with the oblique alignment of a segmented sanding pad, via a lever device or a positioning motor, brings contact rollers back into agreement with pad segments. This invention describes a lever device, or other device serving the same purpose, such as a positioning motor, which while leaving the contact rollers in their original position, moves pad segments laterally in such a way that they remain roughly aligned with the contact rollers.

Embodiments of the device described herein have the advantage over that described in Patent Application PCT/CH2004/000509 in that the fixed contact roller series of the present example embodiments can serve a number of sequential segmented sanding pads with any straight/oblique alignment, while a laterally shifted contact roller series as described in Patent Application PCT/CH2004/000509 can only align with a single specific oblique alignment angle of the sanding pad(s).

Figure 1:
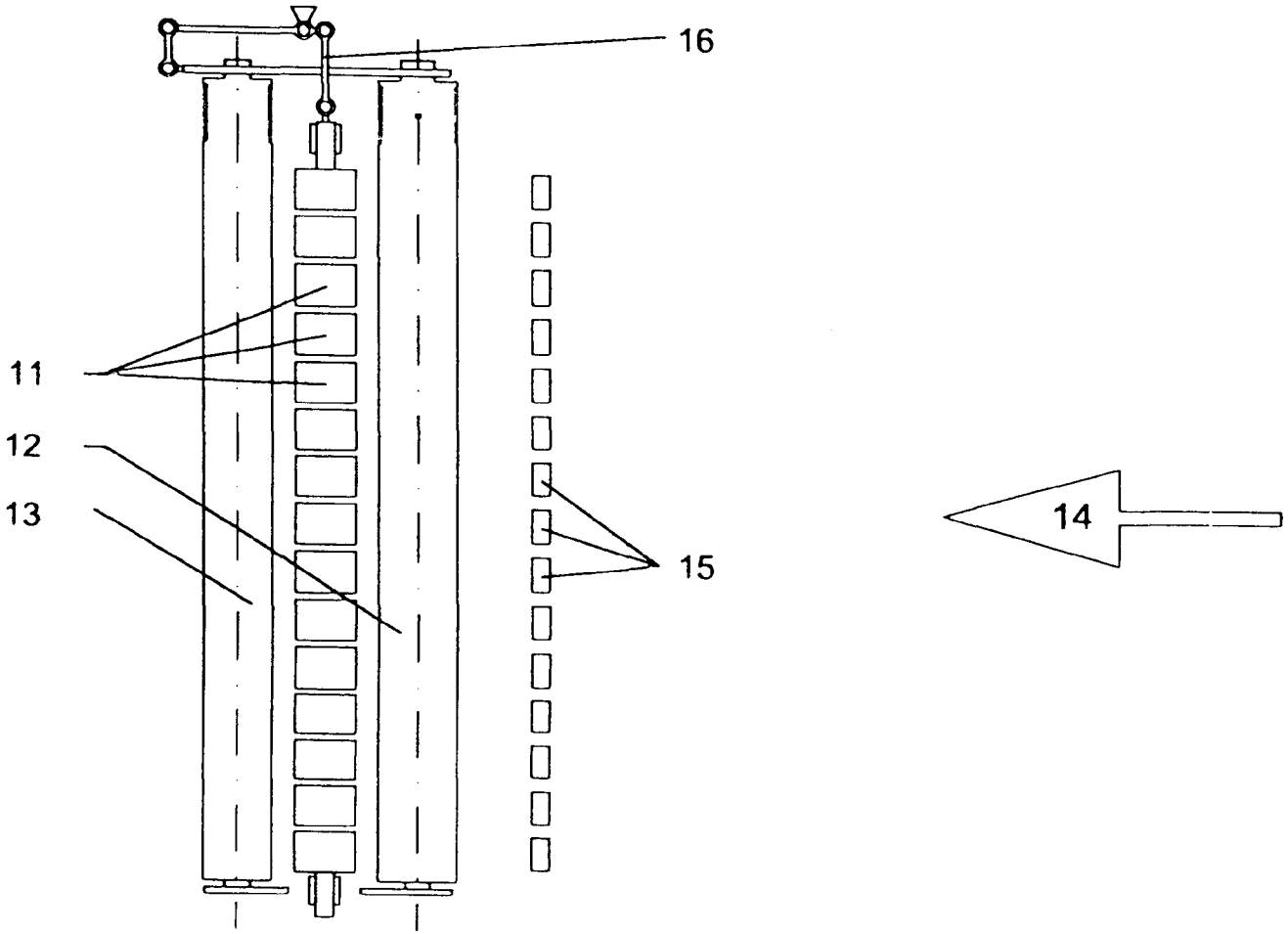
Fig. 1 Related Art
FIG. 1 shows an embodiment having a starting position, with the arrangement of a segmented sanding pad with individually controllable segments (11), the sanding belt deflection rollers (12 and 13), the contact rollers (15) positioned ahead of the pad in the feed direction (14), and a lever device (16) for the sanding elements (11), which effects the lateral shift of these segments when the contact rollers are rotated, in accordance with an example embodiment.
Figure 2:
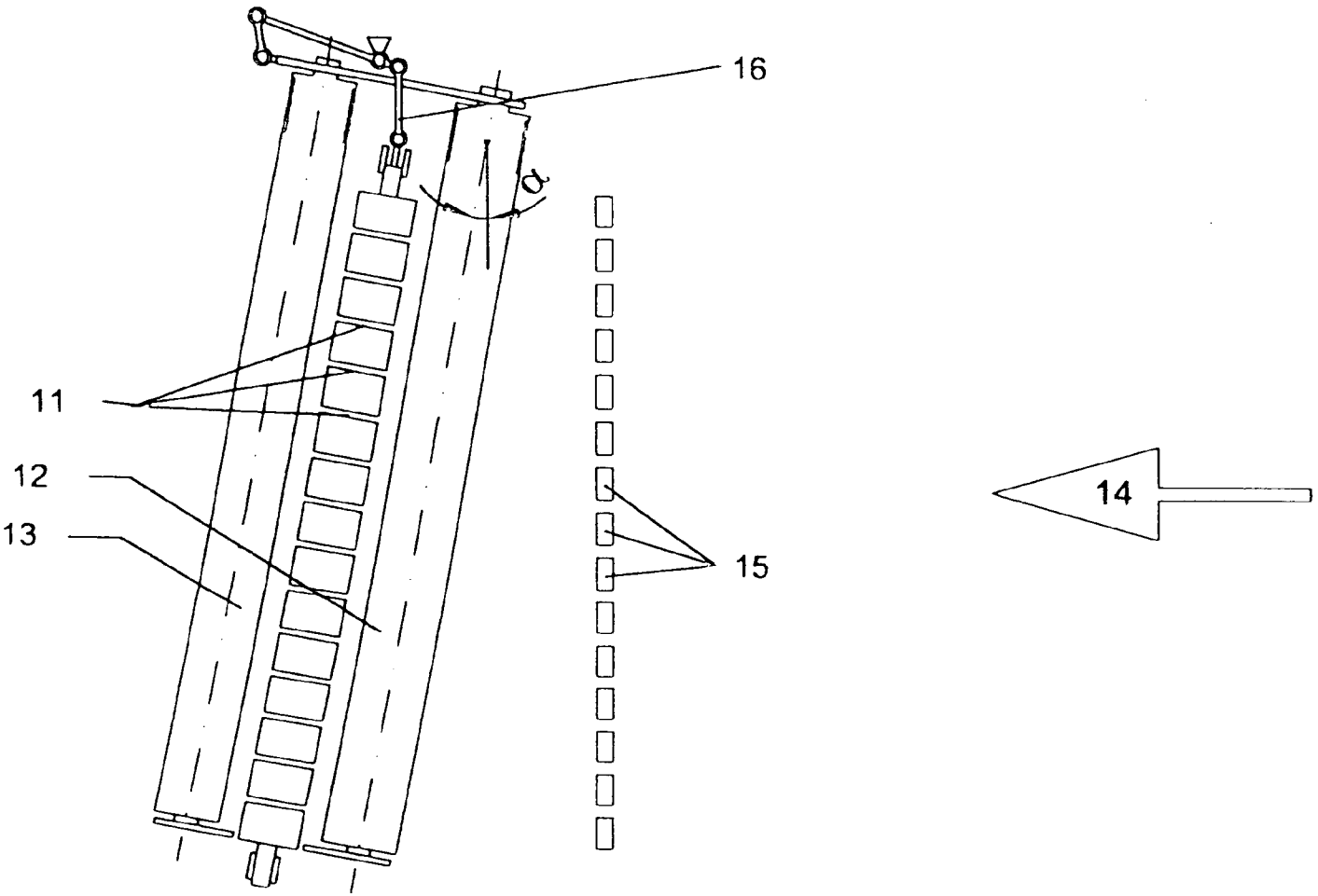
Fig. 2 Related Art
FIG. 2 illustrates the same example embodiment as FIG. 1, but with the segmented sanding pad (11, 12, 13) rotated obliquely through angle α.
Figure 3:
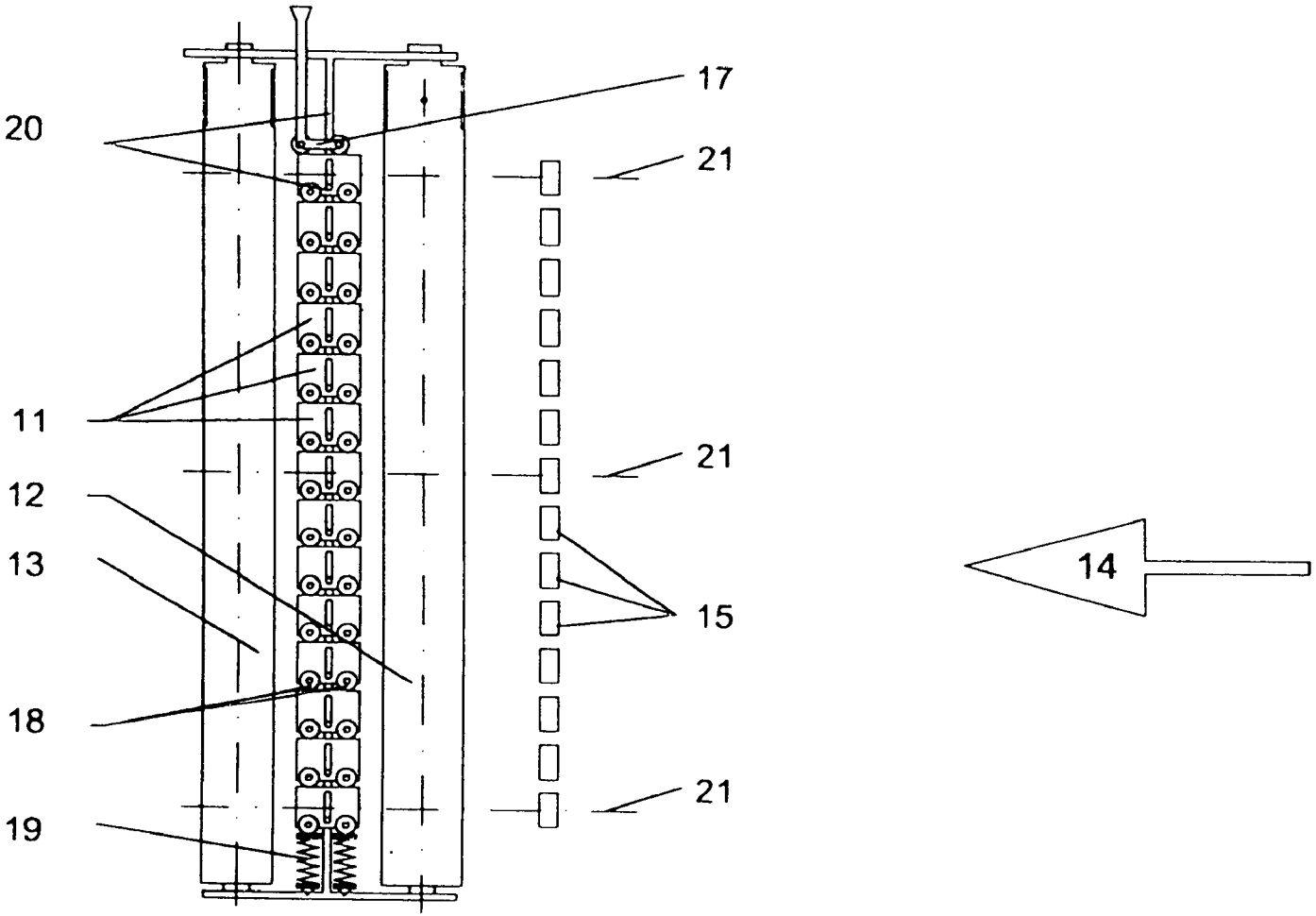
FIG. 3 illustrates an example embodiment similar to FIG. 1, but with a fixed stop (17), with segments (11) fitted with slides (18) and a guide axis (20), and with a counter-pressure device (19).
Figure 4:
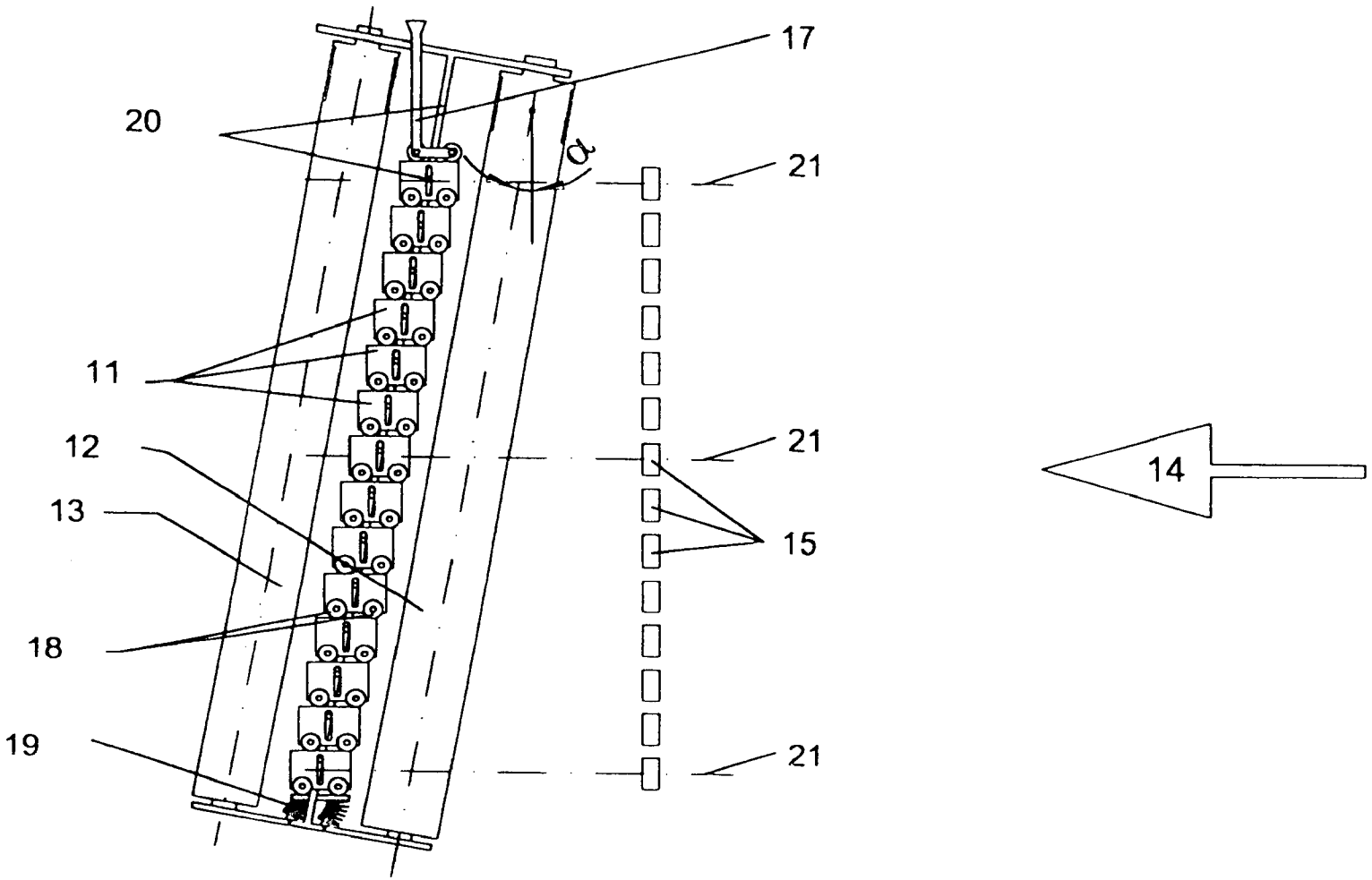
FIG. 4 illustrates the same example embodiment as FIG. 3, but with the segmented sanding pad (11, 12, 13) rotated obliquely through angle α.

In addition, this invention addresses the problem that in an arrangement as per FIGS. 1 and 2, the greater the angle α of the oblique alignment, the more the segments (11) leave the perpendicular with respect the contact rollers (15). To compensate for these differences, in place of a lever device (16) an arrangement is preferred with a fixed stop (17), guiding segments (11, 18), a guide axis (20) and a counter pressure device (19), as shown in FIGS. 3 and 4. In place of the mechanical arrangement, naturally, other devices for the same purposes may be employed, such as motorized electronic or pneumatic type systems.

I claim:

1. A device comprising:

a segmented sanding pad having a plurality of segments, each segment having a longitudinal axis and corresponding to a respective contact roller having a longitudinal axis, wherein, when the sanding pad is moved obliquely, the segments align in accordance with a degree of oblique movement, characterized in that the longitudinal axes of the individual contact rollers and the respective segments are aligned with respect to each other when the gap between the segments is adjusted to the longitudinal axis of the contact rollers.

2. A device comprising:

a segmented sanding pad having a plurality of segments, each segment having a longitudinal axis and corresponding to a respective contact roller having a longitudinal axis, wherein, when the sanding pad is moved to an oblique position, the segments are positioned to align with the respective corresponding contact rollers, characterized in that the longitudinal axes of the individual contact rollers and the respective segments are aligned with respect to each other when the gap between the segments is adjusted to the longitudinal axis of the contact rollers.

* * * * *